US005641027A

United States Patent [19]

Foster

[11] Patent Number: 5,641,027

[45] Date of Patent: Jun. 24, 1997

[54] DRILLING SYSTEM

[75] Inventor: Eugene L. Foster, Alexandria, Va.

[73] Assignee: UTD Incorporated, Newington, Va.

[21] Appl. No.: 370,440

[22] Filed: Jan. 9, 1995

[51] Int. Cl.[6] ..... E21B 4/00

[52] U.S. Cl. ..... 175/107; 175/323; 175/385; 175/394

[58] Field of Search ..... 175/107, 323, 175/340, 386, 388, 393, 394, 391, 385

[56] References Cited

U.S. PATENT DOCUMENTS

| | | | |
|---|---|---|---|
| 187,705 | 2/1877 | Collins . | |
| 2,116,359 | 5/1938 | McCann | 175/323 X |
| 2,250,670 | 7/1941 | Joy . | |
| 2,575,975 | 11/1951 | Robbins | 175/394 X |
| 2,729,067 | 1/1956 | Patterson | 175/394 X |
| 2,794,623 | 6/1957 | Stokes . | |
| 2,919,121 | 12/1959 | Ruth | 175/388 X |
| 2,955,808 | 10/1960 | Kandle | 175/388 X |
| 2,999,572 | 9/1961 | Hinckley | 175/388 X |
| 3,043,383 | 7/1962 | Newbold | 175/383 |
| 3,094,178 | 6/1963 | Newbold | 175/388 |
| 3,174,801 | 3/1965 | Owen et al. | 299/87 |
| 3,226,855 | 1/1966 | Smith | 175/394 X |
| 3,749,189 | 7/1973 | Boehm | 175/394 |
| 4,049,066 | 9/1977 | Richey | 175/107 X |
| 4,087,131 | 5/1978 | Peterson et al. | 299/18 |
| 4,175,626 | 11/1979 | Tummel | 175/107 X |
| 4,275,796 | 6/1981 | Kleine | 175/385 |
| 4,299,295 | 11/1981 | Gossard | 175/45 |
| 4,432,423 | 2/1984 | Lyons et al. | 175/107 X |
| 4,436,168 | 3/1984 | Dismukes | 175/107 X |
| 4,932,482 | 6/1990 | DeLucia | 175/75 |

*Primary Examiner*—Roger J. Schoeppel
*Attorney, Agent, or Firm*—Dickstein Shapiro Morin & Oshinsky LLP

[57] ABSTRACT

A drilling system employs spaced apart cutting members arranged in a helical pattern to form a helical thread within a rock bore. The thread is efficiently fragmented by a wedge-shaped trailing cutting member. Advantageously, a substantial portion of the rock is removed by the fracturing of the internal thread in the rock bore by the uppermost cutting member, taking advantage of the weakness of rock in tension. The rotational speed of the helical cutting system may be controlled as a function of the axial thrust applied to a pilot bit located in front of the helical cutting system.

24 Claims, 4 Drawing Sheets

DRILLING SYSTEM

BACKGROUND OF THE INVENTION

1. Field of the Invention

The present invention relates to a system for drilling holes in hard material, such as rock.

2. Description of the Related Art

Conventional drilling systems employ roller cone bits which operate by successively crushing rock at the base of a bore. Roller cone bits are disadvantageous because rock is typically very resistant to crushing. Other known rock drilling systems employ drag bits. Conventional drag bits operate by shearing rock off at the base of the bore. Drag bits can be more efficient than roller cone bits because rock is typically less resistant to shearing than to crushing.

However, neither roller cone bits nor conventional drag bits attack rock in a way that exploits its weakest property, tensile strength. In addition, roller cone bits and conventional drag bits require the application of substantial axial force to be effective. Consequently, the known systems require drilling equipment of substantial size and power. Likewise, the known systems generally require the use of drill collars, and make it difficult to use stabilizers. Developing sufficient axial thrust is particularly difficult when using short drill strings or when drilling horizontally. Conversely, with long drill strings, the axial force due to the weight of the drill pipe itself may exceed the efficient operating parameters for a particular drill bit, requiring a careful balancing of forces by exerting an upward force on the drill string at the surface.

Prior art drill bits and other excavating devices are disclosed in U.S. Pat. No. 187,705 (Collins), U.S. Pat. No. 2,250,670 (Joy), U.S. Pat. No. 2,794,623 (Stokes), U.S. Pat. No. 3,043,383 (Newbold), U.S. Pat. No. 3,094,178 (Newbold), U.S. Pat. No. 3,174,801 (Owen), U.S. Pat. No. 3,749,189 (Boehm), U.S. Pat. No. 4,275,796 (Kleine), U.S. Pat. No. 4,299,295 (Gossard), U.S. Pat. No. 4,087,131 (Peterson) and U.S. Pat. No. 4,932,482 (DeLucia).

SUMMARY OF THE INVENTION

The disadvantages of the prior art rock drilling devices are overcome to a great extent by the present invention.

The present invention relates to a system comprising a pilot bit for forming a pilot hole, which may be motor driven or which may be a water jet bit, a helical cutting system for forming and breaking a rock thread, and a drill pipe for rotating the helical system.

In one preferred embodiment, pressurized drilling fluid flows through the system and is used to operate the pilot bit motor. In another preferred embodiment, a water jet bit is used with either clean or abrasive water.

Preferably, a control system is provided for controlling the rotational speed of the helical cutting system as a function of the rate of advance of the pilot bit.

The helical cutting system may be formed of spaced apart cutting members. The cutting members remove rock by progressively shearing a helical path through the rock. The resulting internal thread in the rock is broken off by the trailing cutting member. With the present invention, a substantial portion of the rock removed from a hole may be efficiently fractured by tension in bending.

An advantage of the invention is that it may be used with existing surface drilling and pumping equipment. This means that the system may be easily incorporated into existing operations, where it will generally require a lighter rig for drilling to equivalent depths and diameters compared with conventional bits.

An object of the invention is to provide an efficient system for drilling a hole into rock or other hard or brittle materials.

Another object of the invention is to provide a drilling system in which cutting members remove rock by forming a female thread within the rock. The internal rock thread may be efficiently broken off by exerting a "thread stripping" force on the completed internal thread either with a wedge shaped trailing (uppermost) cutting member or a trailing (uppermost) cutting member with a pitch greater than that of the other cutting members. The present invention employs a minimum amount of crushing and shearing.

Another object of the invention is to provide a rock drill bit that does not require equipment of substantial size and power in relation to the size of the bore.

Another object of the invention is to provide a rock drill bit that does not require the use of drill collars and that does not make it difficult to use stabilizers.

Another object of the invention is to provide a thrust neutral rock drill bit capable of pulling or threading itself into the hole.

Other objects and advantages of the present invention will become apparent from the following detailed description and drawings which illustrate preferred embodiments of the present invention.

DETAILED DESCRIPTION OF PREFERRED EMBODIMENTS

Figure 1:
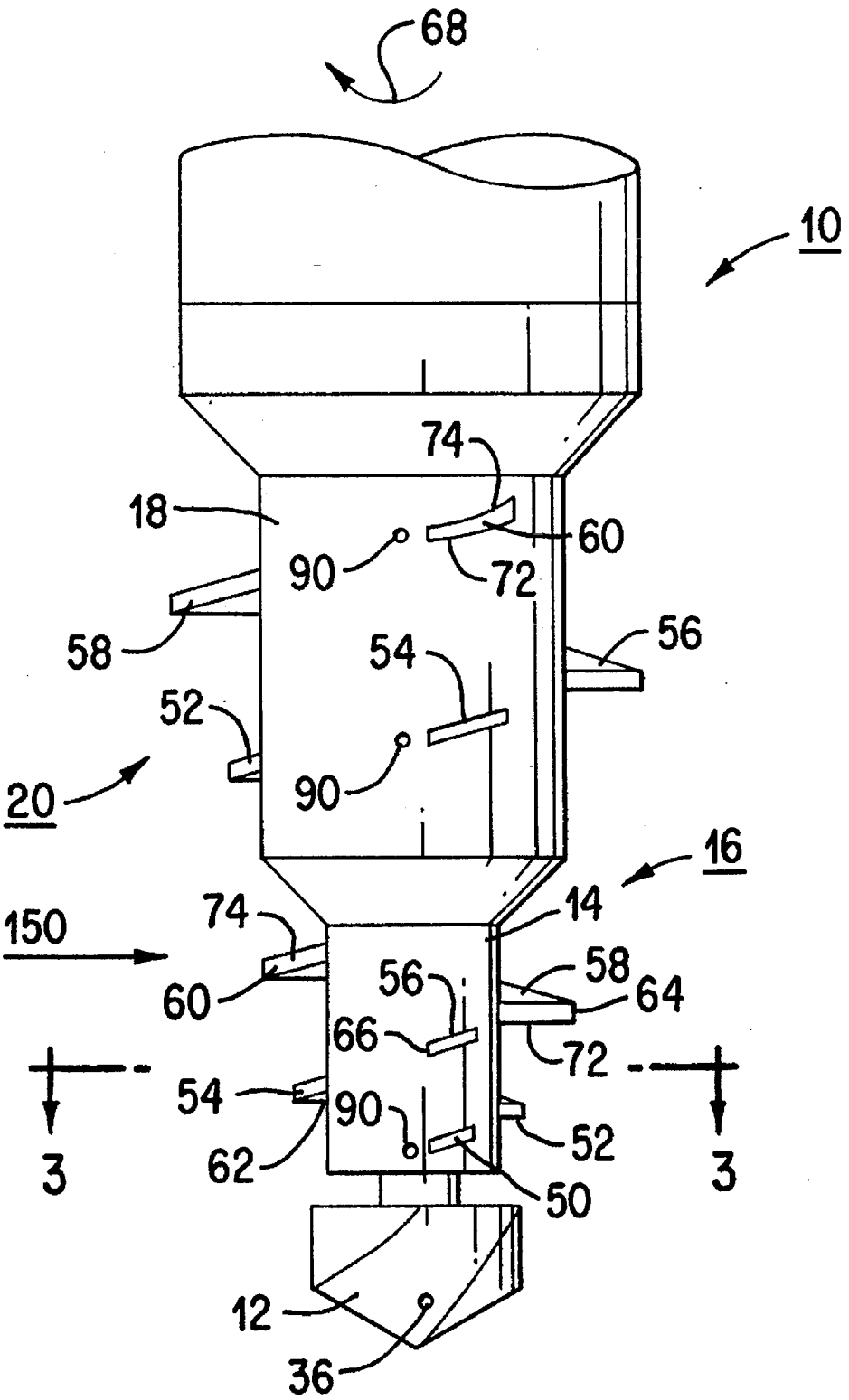
FIG. 1 is an elevational view of a drilling system constructed in accordance with a preferred embodiment of the present invention.
Figure 1A:
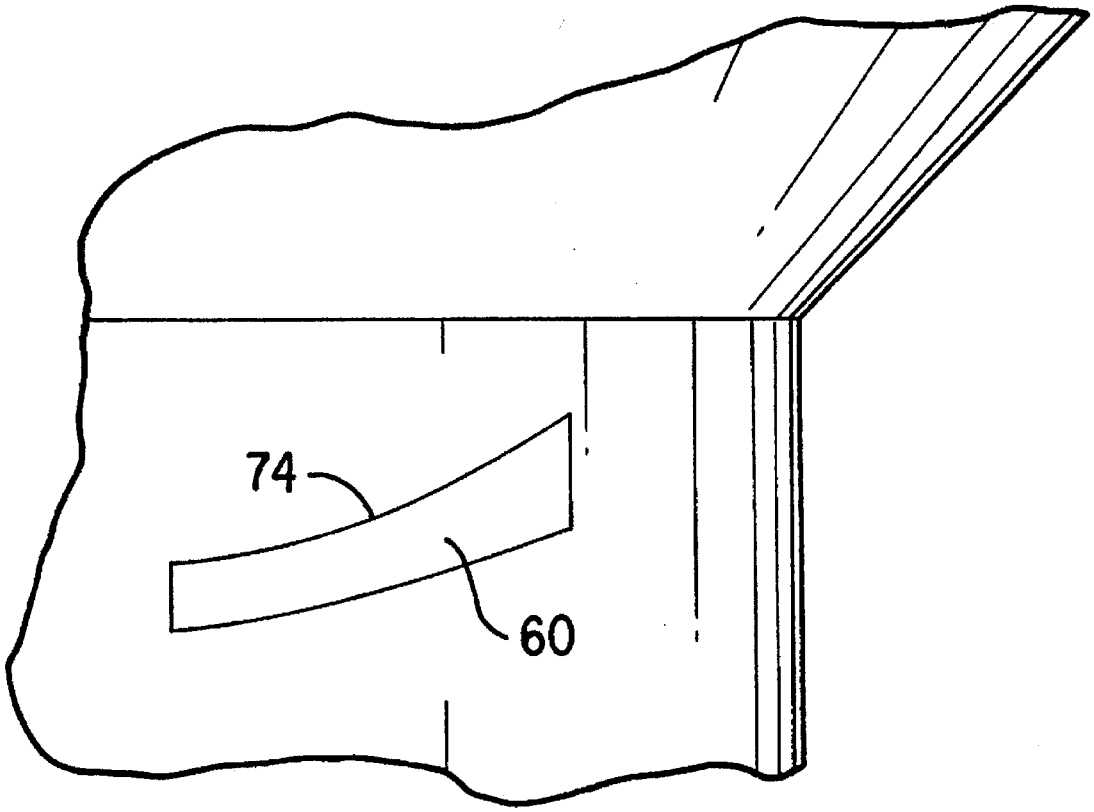
Figure 2:
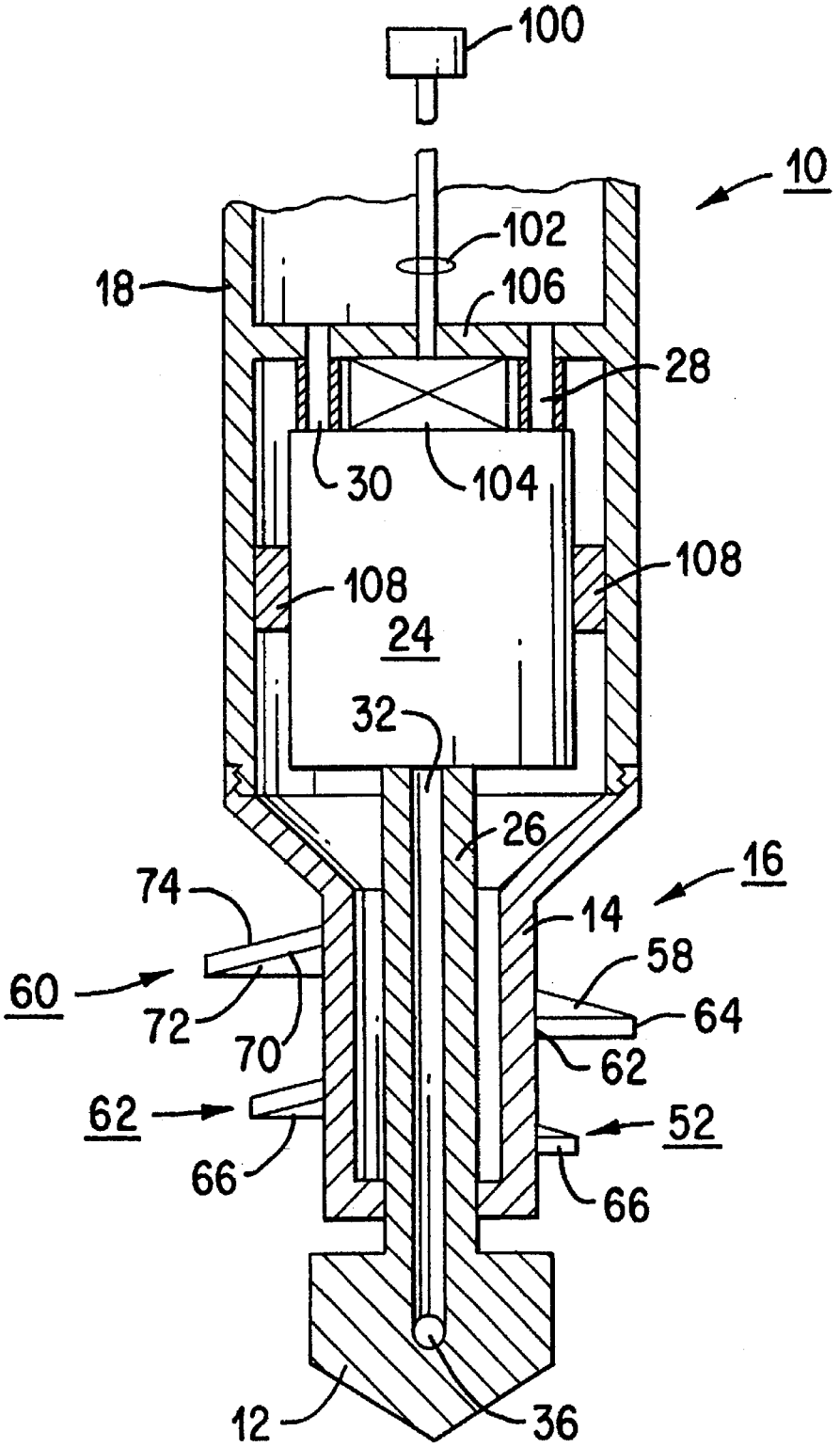
FIG. 2 is an axial cross-sectional view of a portion of the drilling system of FIG. 1.
Figure 3:
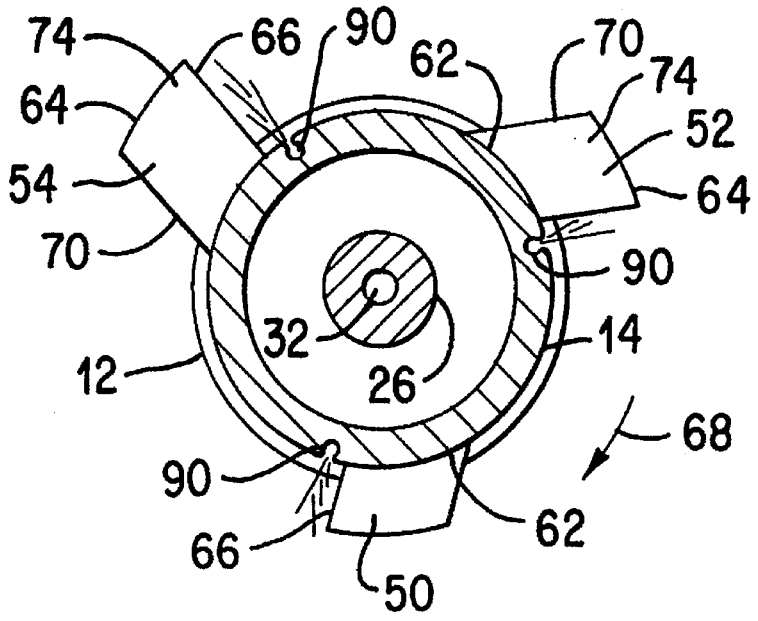
FIG. 3 is a cross-sectional view taken along the line 3—3 of FIG. 1.

Referring now to the drawings, wherein like reference numerals refer to like parts, there is shown in FIGS. 1–3 a drilling system 10 constructed in accordance with a preferred embodiment of the present invention. The drilling system 10 includes a pilot bit 12, a cylindrical drill pipe section 14 with a first helical cutting system 16, and a second cylindrical drill pipe section 18. A second helical cutting system 20 is located on the second drill pipe section 18.

The pilot bit 12 may be rotated at high speed (for example, within a range of from one hundred to five hundred revolutions per minute) by a motor 24 (FIG. 2). The motor 24 may be, for example, a positive displacement muck motor or a turbo-mud motor. The pilot bit 12 is operatively connected to the motor 24 by a shaft 26. The motor 24 is driven by pressurized drilling fluid flowing through conduits 28, 30. The fluid flows out of the motor 24 through an axial passageway 32. The passageway 32 is preferably located coaxially within the shaft 26.

The diameter of the pilot hole 34 (FIG. 4) formed by the pilot bit 12 is greater than the diameter of the first drill pipe section 14. Rock fragments (not shown) created by the pilot bit 12 are flushed upwardly to the surface by the drilling fluid. The drilling fluid flows upwardly from the pilot hole 34 along the exterior of the drill pipe 14, 18. Connecting passageways 36 (FIG. 2) are provided for flowing the drilling fluid from the passageway 32 to the exterior of the pilot bit 12.

Each helical cutting system 16, 20 is formed of six spaced apart cutting members 50–60. Each cutting member 50–60 has an inner edge 62 attached to the drill pipe section 14, a radial outer edge 64 for shearing rock as the system 10 is rotated in the drilling direction 68, a leading edge 66, a trailing edge 70, a bottom surface 72 (FIG. 1), and a top surface 74. Each succeeding cutting member 52–60 extends further in the radial direction than the preceding cutting member 50–58. The leading edge 66 of each cutting member 50–60 is lower than the corresponding trailing edge 70. Thus, the cutting members 50–60 form a helix pattern. The pitch of the helix is constant. The diameter of the helix increases from bottom to top.

In operation, the drill pipe 14, 18 is rotated in the drilling direction 68, causing the cutting members 50–60 to cut a female thread 80 (FIG. 4) into a rock bore. The thread 80 is bent and broken into fragments 82 by the trailing cutting member 60. As shown in FIG. 1, the top and bottom surfaces 74, 72 of the sixth cutting member 60 form a wedge for breaking the rock thread 80 into fragments 82. Alternatively, the pitch of the fifth and sixth cutting members 58, 60, can be increased to "strip" the rock thread.

The first helical cutting system 16 has an effective diameter at its upper end (i.e., at the sixth cutting member 60) that is greater than the diameter of the second drill pipe section 18.

Nozzles 90 for the high pressure distribution of drilling fluid are disposed adjacent to the leading edges 66 of each cutting member 50–60. The nozzles 90 are supplied with drilling fluid which flows around the motor and through the annular space between the shaft 26 and the cylindrical drill pipe section 14. The nozzles 90 aid in the shearing of the rock by the cutting members 50–60. The water jets 90 are aimed at all of the cutting surfaces 66. The drilling fluid sprayed by the jets 90 cools the blades 66 and extends their useful lives, while at the same time helping to remove the cuttings (rock fragments).

The second helical cutting system 20 is essentially the same as the first system 16, except that the second system 20 has a greater effective diameter.

The helical cutting systems 16, 20 are rotated by the drill pipe 14, 18. In the illustrated embodiment, the drill pipe 14, 18 rotates much more slowly than the pilot bit 12. For example, the drill pipe 14, 18 may be rotated at about thirty revolutions per minute.

The cutting systems 16, 20 resemble an auger. However, an auger travels axially a distance much less than its pitch for each revolution of the auger. By turning faster than its pitch, the auger displaces drilling waste to the surface. In contrast, each helical cutting system 16, 20 travels a distance equal to its pitch for each revolution, like a tap. The helical cutting systems 16, 20 operate with minimum axial thrust applied through the drill pipe 14, 18. Indeed, the system can be designed to be thrust neutral. The equipment at the surface only needs to apply a torque to the drill pipe 14, 18, and a small axial thrust if the system is designed to require it for reasons of stability.

The rotational speed of the helical cutting systems 16, 20 may be controlled by a feedback system 100 (FIG. 2). The feedback system 100 is connected by electrical leads 102 to a load cell 104. The load cell 104 is located between the motor 24 and a plate 106 fixed within the drill pipe section 18. The motor 24 is positioned within the drill pipe section 18 by a connecting structure 108. The load cell 104 is disposed between the upper surface of the motor 24 and the lower surface of the plate 106. The connecting structure 108 transmits torque from the drill pipe 18 to the motor 24 without transferring any axial thrust to the motor 24. Axial force is applied to the motor 24 through the load cell 104. The motor 24 is axially fixed with respect to the pilot bit 12 by the shaft 26. Thus, the load cell 104 may be used to measure the axial force between the pilot bit 12 and the bottom 110 (FIG. 4) of the pilot hole 34.

In operation, downward force on the pilot bit 12 is provided by the advancement of the helical cutting systems 16, 20. Therefore, when the load cell 104 senses that the axial thrust on the pilot bit 12 is excessive, the rotational speed of the drill pipe sections 14, 18 (and the integral helical cutting systems 16, 20) is reduced by the control system 100. When the load cell 104 senses that the axial thrust applied to the pilot bit 12 is reduced to a value that is not efficient for drilling, then the control system 100 causes the drill pipe 14, 18 to rotate more rapidly.

The economics of using rock fracturing drill bits will be affected by the ratio of the effective diameter of the first and second helical cutting systems 16, 20 to the diameter of the pilot bit 12. The larger the ratio, the more power will be saved because more of the rock will be broken and removed by bending. For example, if the effective diameter of the second helical cutting system 20 is twice the diameter of the pilot bit 12, then three-quarters of the rock removed (less the thread grooves) will be fragmented by the more economical bending failure process.

Figure 4:
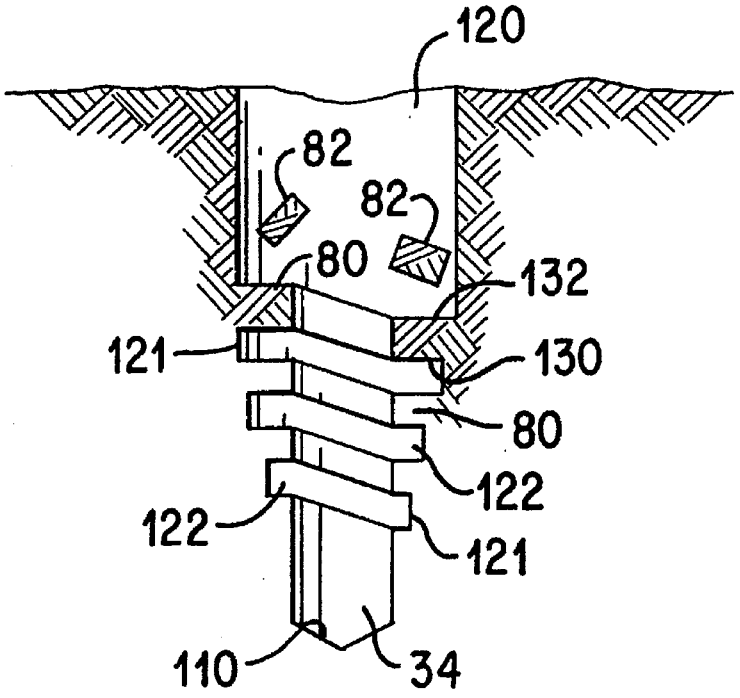
FIG. 4 is a schematic axial cross-sectional view of a drilled hole illustrating how the drilling system of FIG. 1 cuts and breaks a rock thread.

In operation, the drilling system 10 is engaged within a rock bore 120 (FIG. 4). The pilot bit 12, rotated by the motor 24, forms the pilot hole 34. As the drill pipe 14, 18 is rotated within the bore 120, the first helical cutting system 16 shears a groove 122 into the wall of the bore 120, and each successive cutting member 52–60 cuts the groove 122 deeper into the bore wall producing an internal thread 80. In effect, the cutting members 50–60 operate as a tap. The helical configuration allows the cutting system 16 to draw the system 10 further into the bore 120. The resulting axial force is sufficient to provide the thrust needed by the pilot bit 12. Thus, the system 10 is a neutral thrust system, which is advantageous. The system 10 may be operated with only torque and pressurized drilling fluid from the surface.

As the system 10 rotates and advances downward, the helical groove 122 is progressively deepened until it reaches full depth. Then, the upper surface 74 of the sixth cutting member 60 comes into contact with a lower flank 130 of the thread 80 and forces the thread 80 upward. When the thread 80 is forced upward, an upper flank 132 of the thread 80 is in compression and the lower flank 130 is in tension. As the sixth cutting member 60 rotates through the groove 122, the tension in the lower flank 130 increases to the point where thread 80 fractures from the wall of the bore 120 and is broken away into rock fragments 82. In effect, the rock thread 80 is stripped from the wall of the hole 120 by the trailing cutting member 60.

While the system 10 rotates and advances downward, each cutting member 50–60 exerts equivalent radial forces against the outer surface 121 of the groove 122. The resulting radial force balance provides stability to the system 10 promoting constant cutting depths for each cutting member 50–60, leading to improved cutting efficiency. An advantage of the illustrated system is that the radial forces on the cutting members 50–60 are balanced. This balance is achieved by arranging the cutting members equi-angularly around the drill pipe 14, 18.

During the drilling operation, some of the drilling fluid is pumped to pilot bit 12 where it aids in the cutting of the pilot bore 34. The drilling fluid then is exhausted from the bore 120 through arcuate spaces defined between the drill pipe 14, 18, the wall of the bore 120, and the spaced apart cutting members 50–60. The drilling fluid carries the rock fragments and other waste up and out of the bore 120. The same drilling fluid that is used to remove rock fragments 82 from the bore 120 is also used to operate the motor 24 to rotate the pilot bit 12.

Some of the drilling fluid is routed to the motor 24 through the ports 28 and 30. The remainder is pumped downward through the annular space between the motor 24 and the cylindrical drill pipe section 18 and between the shaft 26 and the cylindrical drill pipe section 14. Holes through the walls of these pipes hold nozzles 90 located adjacent to each cutting member. Drilling fluid passing over the surfaces of the cutting member cools it and prolongs its life. Leaving the surfaces of the cutter, the drilling fluid impinges on the rock, where it assists in cuttings removal. Finally, the drilling fluid flows up through the annular space between the drill pipe and the rock walls of the hole 120, carrying the cuttings to the surface.

The axial force on the load cell 104 is monitored and the turning rate of the drill pipe 14, 18 is adjusted by the control system 100 to optimize the performance of the pilot bit 12.

In a preferred embodiment of the invention, the outer (cutting) edges 64 and the leading edges 66 of the cutting members 50–60 may have polycrystalline diamond (PDC or TSP) surfaces for efficient cutting and long bit life. When hardened in this manner, the system 10 may be used to drill several thousands of feet of hole.

The system 10 has been described in terms of a vertical well drilling operation. However, the present invention may be used for other applications. In particular, the present invention may be used in many orientations and in many rock drilling procedures, including slanted and horizontal holes, where the neutral thrust feature of the invention is a particular advantage.

The present invention is not limited to the specific drill bit 12 shown in the drawings. The pilot hole 34 for the first helical cutting system 16 may be formed by a roller cone bit, a drag bit, a clean or abrasive water jet, or by any other suitable excavating system.

Although the drawings illustrate two helical cutting systems (16 and 20), the reader will understand that one could employ three or four or more helical cutting systems on the same bit. This permits optimizing the cutting action for different hole diameters in the rock.

The above description is intended to illustrate preferred embodiments which can achieve the objects, features and advantages of the present invention. It is not intended that the present invention be limited thereto. Any modification coming within the spirit and scope of the following claims is to be considered part of the present invention.

What is claimed as new and desired to be protected by Letters Patent of the United States is:

1. A system for drilling into surface rock, said system comprising:

a pilot bit;

means for rotating said pilot bit to form a pilot hole in said surface rock, said pilot hole being surrounded by sidewalls which define said pilot hole;

a first helical system for cutting a thread pattern into said sidewalls, wherein said thread pattern includes threads having a radial dimension, and for subsequently breaking said thread pattern in said sidewalls by bending said threads in a direction transverse to said radial dimension; and a drill pipe for rotating said helical system.

2. The drilling system of claim 1, further comprising a passageway for flowing pressurized drilling fluid into said pilot hole, wherein said first helical system is located above said pilot bit and surrounds said drill pipe.

3. The drilling system of claim 1, wherein said pilot bit is a high pressure water jet bit which exerts a cutting force for drilling the pilot hole.

4. The drilling system of claim 1, wherein said helical system includes a first set of spaced apart discrete cutting members that extend from and are arranged in a helical pattern around said pipe; and wherein said first set of spaced apart discrete cutting members cut the rock to form said thread pattern.

5. The drilling system of claim 4, wherein each of said spaced apart cutting members maintains radial contact with said sidewalls, whereby a radial thrust balance is obtained.

6. The drilling system of claim 4, further comprising a second set of spaced apart discrete cutting members extending from and arranged in a helical pattern around said pipe;

wherein said second set of spaced apart discrete cutting members cut said rock to extend the effective diameter of said thread pattern formed of remaining rock and subsequently bend said remaining rock to break said thread pattern; and wherein said second set of discrete cutting members includes a trailing cutting member that extends from said pipe such that said trailing cutting member makes a trailing angle with said pipe that enables said trailing cutting member to bend said thread pattern.

7. The drilling system of claim 6, wherein said trailing cutting member includes a top and bottom surface which form a wedge for breaking said thread pattern.

8. The drilling system of claim 6, further comprising a pre-trailing cutting member located closest to said trailing cutting member;

wherein said spaced apart cutting members extend in a radial direction at a constant pitch, and wherein said pre-trailing cutting member and said trailing cutting member extend in a radial direction at an increased pitch which causes said thread pattern to break.

9. The drilling system of claim 4, wherein said spaced apart cutting members further comprise a trailing edge and a leading edge located lower than said trailing edge such that said spaced apart cutting members define a helix pattern having a bottom, a top, a constant pitch, and an increasing diameter from said bottom to said top; and wherein said spaced apart members extend further in a radial direction progressing along said helix pattern from said bottom to said top.

10. The drilling system of claim 4, further comprising nozzles for spraying drilling fluid towards the intersection of said cutting members and said sidewalls.

11. A method of drilling a hole into rock, said method comprising the steps of:

forming a pilot hole in said rock, said pilot hole having a first diameter and being defined by surrounding sidewalls;

rotating a helical cutting system into said pilot hole, and thereby cutting a thread pattern into the sidewalls defining said pilot hole, said thread pattern having a diameter greater than said first diameter, and wherein said helical cutting system extends radially outward from a drill pipe; and bending said thread pattern in said sidewalls to break the rock and form rock fragments.

12. The method of claim 11, wherein said helical cutting system is formed of spaced apart discrete cutting members, said cutting members including a trailing cutting member with a surface arranged at an angle for bending said thread pattern.

13. The method of claim 12, further comprising the step of spraying drilling fluid towards the intersection of said cutting members and said sidewalls.

14. The method of claim 11, wherein said pilot hole is formed by a pilot bit.

15. A method of drilling a hole into rock, said method comprising the steps of:

forming a pilot hole in said rock, said pilot hole having first diameter;

rotating a helical cutting system into said pilot hole, and thereby forming a thread pattern in said pilot hole, said thread pattern having a diameter greater than said first diameter; and breaking said thread pattern to form rock fragments, wherein said helical system is rotated by a drill pipe, wherein said pilot hole is formed by a pilot bit, and wherein said pilot bit is operated by a mud motor.

16. The method of claim 15, wherein said mud motor is operated by pressurized drilling fluid, and wherein said pressurized drilling fluid flushes said rock fragments axially away from said helical cutting system between said cutting members.

17. The method of claim 16, further comprising the step of controlling the rotational speed of said helical system.

18. The method of claim 17, wherein said step of controlling the rotational speed of said helical system includes the step of sensing the axial force applied to said drill bit.

19. The method of claim 18, wherein said sensing step includes the step of sensing the axial thrust of said mud motor with respect to said drill pipe.

20. A system for drilling into hard material, said system comprising:

a pilot bit:

means for rotating said pilot bit to form a pilot hole in said hard material, said pilot hole being surrounded by sidewalls which define said pilot hole;

a first helical system for cutting a thread pattern into said sidewalls and for subsequently breaking said thread pattern in said sidewalls; and a drill pipe for rotating said helical system; and a passageway for flowing pressurized drilling fluid into said pilot hole; and wherein said rotating means is a mud motor operated by the pressurized drilling fluid.

21. A system for drilling into hard material, said system comprising:

a pilot bit;

means for rotating said pilot bit to form a pilot hole in said hard material, said pilot hole being surrounded by sidewalls which define said pilot hole;

a first helical system for cutting a thread pattern into said sidewalls and for subsequently breaking said thread pattern in said sidewalls; and a drill pipe for rotating said helical system; and a control system for controlling the rotational speed of said helical system independently of the rotational speed of the pilot bit.

22. The drilling system of claim 21, wherein said control system regulates the rotational speed of said helical system based on drilling conditions.

23. The drilling system of claim 21, wherein said control system includes a load cell for sensing the axial force applied to said pilot bit.

24. The drilling system of claim 23, wherein said rotating means is a motor axially movable with respect to said drill pipe and axially fixed with respect to said pilot bit, and wherein said motor is located between said load cell and said pilot bit.

* * * * *